US007905322B2

(12) United States Patent
Woods et al.

(10) Patent No.: US 7,905,322 B2
(45) **Date of Patent: *Mar. 15, 2011**

(54) MARINE MUFFLER WITH ANGULARLY DISPOSED INTERNAL BAFFLE

(76) Inventors: Woodrow Woods, Riviera Beach, FL (US); Darrin Woods, Riviera Beach, FL (US); Craig McLeod, Riviera Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/690,341

(22) Filed: Jan. 20, 2010

(65) Prior Publication Data

US 2010/0116585 A1 May 13, 2010

Related U.S. Application Data

(63) Continuation-in-part of application No. 12/548,548, filed on Aug. 27, 2009, and a continuation-in-part of application No. 11/891,481, filed on Aug. 10, 2007, now Pat. No. 7,581,620.

(60) Provisional application No. 60/837,350, filed on Aug. 10, 2006.

(51) Int. Cl.
*F01N 1/08* (2006.01)
*F01N 1/02* (2006.01)
*F01N 1/00* (2006.01)

(52) U.S. Cl. ..... 181/264; 181/272; 181/281; 181/233

(58) Field of Classification Search ..... 181/264, 181/269, 272, 281, 233, 234, 235, 275, 258, 181/259, 260

See application file for complete search history.

(56) References Cited

U.S. PATENT DOCUMENTS

| | | | | | |
|---|---|---|---|---|---|
| 1,028,847 | A | * | 6/1912 | Snyder | 181/264 |
| 2,019,746 | A | * | 11/1935 | Tatter | 181/281 |
| 2,169,359 | A | * | 8/1939 | Jones et al. | 181/233 |
| 2,216,763 | A | * | 10/1940 | Boyce | 96/386 |
| 2,328,161 | A | * | 8/1943 | Hamilton | 181/260 |
| 2,360,429 | A | * | 10/1944 | Leadbetter | 181/260 |
| 2,718,274 | A | * | 9/1955 | Kimbal | 181/264 |
| 2,933,148 | A | * | 4/1960 | Hendry | 181/246 |
| 3,033,306 | A | * | 5/1962 | Hallene et al. | 181/233 |
| 3,232,374 | A | * | 2/1966 | Powers | 181/245 |
| 4,109,754 | A | * | 8/1978 | Purhonen | 181/252 |
| 4,192,404 | A | * | 3/1980 | Nakagawa et al. | 181/272 |

(Continued)

FOREIGN PATENT DOCUMENTS

JP 05098939 A * 4/1993

*Primary Examiner* — Edgardo San Martin
(74) *Attorney, Agent, or Firm* — Mark D. Bowen, Esq.; Malin Haley DiMaggio Bowen & Lhota, P.A.

(57) ABSTRACT

A marine muffler comprises an elongate cylindrical housing having an inlet and an outlet and defining an internal volume partitioned, by an angularly disposed internal baffle, into a lower chamber in communication with the inlet and an upper chamber in communication with the outlet. A vertically disposed duct is insertably secured to the baffle to allow exhaust gas and exhaust cooling water to flow from the lower inlet chamber to upper outlet chamber. The exhaust duct may preferably be further adapted with internal structure forming a plurality of individual flow conduits or passages. The duct is preferably positioned such that a plurality of flow passage inlets are positioned in proximity to the lower cylindrical housing wall, with flow passage outlets positioned in proximity to the upper housing wall. The lower duct wall may further be adapted with sidewall apertures for improving exhaust flow dynamics therethrough.

13 Claims, 8 Drawing Sheets

U.S. PATENT DOCUMENTS 4,305,477 A * 12/1981 Moore ..... 181/249
4,416,350 A * 11/1983 Hayashi ..... 181/272
4,467,887 A * 8/1984 Vizard ..... 181/265
4,605,092 A * 8/1986 Harris et al. ..... 181/280
4,673,058 A * 6/1987 Roberts et al. ..... 181/266
4,735,283 A * 4/1988 Macaluso ..... 181/265
4,778,029 A * 10/1988 Thornburgh ..... 181/229
4,917,640 A * 4/1990 Miles, Jr. ..... 440/89 R
4,918,917 A 4/1990 Woods
5,145,026 A * 9/1992 Wilder ..... 181/233
5,196,655 A 3/1993 Woods
5,228,876 A 7/1993 Woods
5,262,600 A 11/1993 Woods
5,285,026 A * 2/1994 Lemetyinen ..... 181/224
5,326,942 A * 7/1994 Schmid ..... 181/235
5,444,196 A 8/1995 Woods
5,492,195 A * 2/1996 Zink et al. ..... 181/264
5,504,280 A 4/1996 Woods
5,588,888 A * 12/1996 Magharious ..... 440/89 R
5,616,893 A 4/1997 Woods
5,625,173 A 4/1997 Woods
5,679,931 A * 10/1997 Furse et al. ..... 181/224
5,718,462 A 2/1998 Woods
5,740,670 A 4/1998 Woods
5,934,959 A 8/1999 Inman, Sr.
6,024,617 A * 2/2000 Smullin et al. ..... 440/89 R
6,035,633 A 3/2000 Woods
6,152,258 A 11/2000 Deavers
6,241,044 B1 * 6/2001 Nishiyama et al. ..... 181/272
6,393,835 B1 * 5/2002 Stoll et al. ..... 60/299
6,427,802 B1 * 8/2002 Yokoi et al. ..... 181/282
6,443,255 B1 9/2002 Shavender, Jr.
6,478,645 B1 * 11/2002 Allbright et al. ..... 440/89 R
6,564,901 B2 5/2003 Woods
6,591,939 B2 * 7/2003 Smullin et al. ..... 181/260
6,651,773 B1 * 11/2003 Marocco ..... 181/270
7,581,620 B2 * 9/2009 Woods et al. ..... 181/264
7,694,778 B2 * 4/2010 Toyoshima et al. ..... 181/268

* cited by examiner

MARINE MUFFLER WITH ANGULARLY DISPOSED INTERNAL BAFFLE

CROSS REFERENCE TO RELATED APPLICATIONS

This application is a continuation in part of U.S. patent application Ser. No. 12/548,548, filed on Aug. 27, 2009, which is a continuation of U.S. patent application Ser. No. 11/891,481, filed Aug. 10, 2007, now U.S. Pat. No. 7,581,620, which claims the benefit of provisional U.S. Patent Application No. 60/837,350, filed Aug. 10, 2006.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates generally to exhaust systems and mufflers for use with internal combustion marine engines, and more particularly to an improved marine engine muffler having an inclined baffle assembly that provides improved exhaust and water handling capability and enhanced noise reduction.

2. Description of Related Art

Marine vessels are typically configured with a propulsion system having an internal combustion engine mounted internally within the vessel hull. Exhaust generated by the engine is commonly combined with cooling water and routed through exhaust conduit to the stern or rear of the vessel via one or more exhaust ducts for discharge through one or more exhaust ports formed in the transom. One or more silencers may be installed within the exhaust duct(s) to silence noise associated with the engine and exhaust gases.

A variety of structures are known in the background art for use in silencing marine exhaust noise. The present inventor has invented a number of novel marine exhaust components that have greatly improved the silencing and efficiency of marine exhaust systems. Among those inventions developed by a named inventor for the present invention are the following:

| U.S. Pat. No. | Entitled |
|---|---|
| 4,918,917 | Liquid Cooled Exhaust Flange |
| 5,196,655 | Muffler for Marine Engines |
| 5,228,876 | Marine Exhaust System Component Comprising a Heat Resistant Conduit |
| 5,262,600 | In-line Insertion Muffler for Marine Engines |
| 5,444,196 | In-line Insertion Muffler for Marine Engines |
| 5,504,280 | Muffler for Marine Engines |
| 5,616,893 | Reverse Entry Muffler With Surge Suppression Feature |
| 5,625,173 | Single Baffle Linear Muffler for Marine Engines |

-continued

| U.S. Pat. No. | Entitled |
|---|---|
| 5,718,462 | Muffler Tube Coupling With Reinforcing Inserts |
| 5,740,670 | Water Jacketed Exhaust Pipe for Marine Exhaust Systems. |
| 6,564,901 | Muffler for Marine Engine |

In U.S. Pat. No. 5,262,600, the first named inventor herein disclosed an in-line insertion muffler for marine engines employing a first housing encompassing a second housing which is partitioned by an angularly disposed inner planar baffle that has proven extremely effective in reducing engine noise. In U.S. Pat. No. 5,444,196, the first named inventor herein disclosed an improved version of the in-line muffler having a corrugated sleeve disposed between in the first and second housings. In U.S. Pat. No. 5,625,173, the first named inventor herein disclosed a single baffle linear muffler with an angularly disposed baffle that may be planer, convex, or concave.

The various linear mufflers made in accordance with the above-referenced patents have achieved tremendous success and widespread acceptance within the marine industry. Such muffler systems have been successfully installed on a wide variety of marine vessels having engines in excess of 1,000 horsepower. Current trends in marine vessel design, however, have resulted in reduced or very limited space availability for propulsion system components such as muffler systems. In addition, space limitations present in the retrofit and re-powering of existing marine vessels often present significant space limitations relating to the replacement of muffler systems. While the linear mufflers known in the art are suitable for a wide variety of marine applications, there exists a need for an improved linear muffler that is compact and suitable for use in high horsepower applications.

BRIEF SUMMARY OF THE INVENTION

The present invention overcomes limitations present in the art by providing an improved muffler for marine engines that is compact, and provides improved performance in terms of silencing and backpressure characteristics, as well as ease of manufacturing and installation. A marine muffler comprises an elongate housing having an inlet and an outlet and defining an internal volume. The internal volume is partitioned into upper and lower chambers by an angularly disposed internal baffle, with the lower chamber in communication with the inlet and the upper chamber in communication with the outlet. The baffle is adapted with at least one vertically disposed duct to allow exhaust gas and exhaust cooling water to flow from the lower inlet chamber to upper outlet chamber. The exhaust duct may preferably be further adapted with internal structure forming a plurality of individual non-circular flow conduits or passages. The duct is preferably positioned such that a plurality of flow passage inlets are disposed in proximity to the lower housing wall, with flow passage outlets positioned in proximity to the upper housing wall. The lower duct walls may further be adapted with sidewall apertures for improving exhaust flow dynamics through the duct. Structure is provided to provide rigidity in embodiments that use muffler housings having rectangular cross-sections and/or planar surfaces.

Accordingly, it is an object of the present invention to provide a marine muffler adapted with an internal angularly disposed primary baffle.

Still another object of the present invention is to provide such a marine muffler wherein the baffle partitions the muffler into a lower inlet chamber and an upper outlet chamber.

Yet another object of the present invention is to provide such a muffler wherein the baffle is adapted with a duct in communication with said inlet and outlet chambers.

Still another object of the present invention is to provide such a muffler wherein the duct is partitioned into a plurality of sub-passages.

Yet another object of the present invention is to provide such a muffler the lower duct wall defines a plurality of apertures to improve water entrainment.

Another object of the present invention is to provide a marine muffler having a housing that is generally rectangular to enable the muffler to be installed between the structural elements (e.g. stringers) of the vessel.

In accordance with these and other objects, which will become apparent hereinafter, the instant invention will now be described with particular reference to the accompanying drawings.

DETAILED DESCRIPTION OF THE INVENTION

Figure 1:
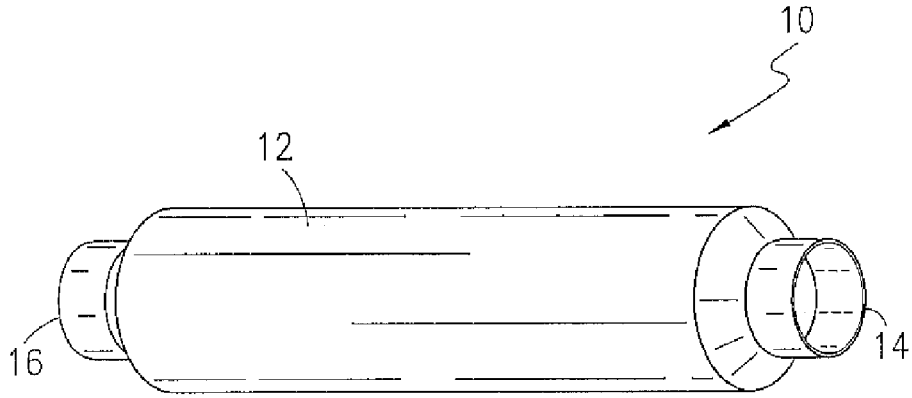
FIG. 1 is a perspective view of a marine engine muffler in accordance with the present invention.
Figure 2:
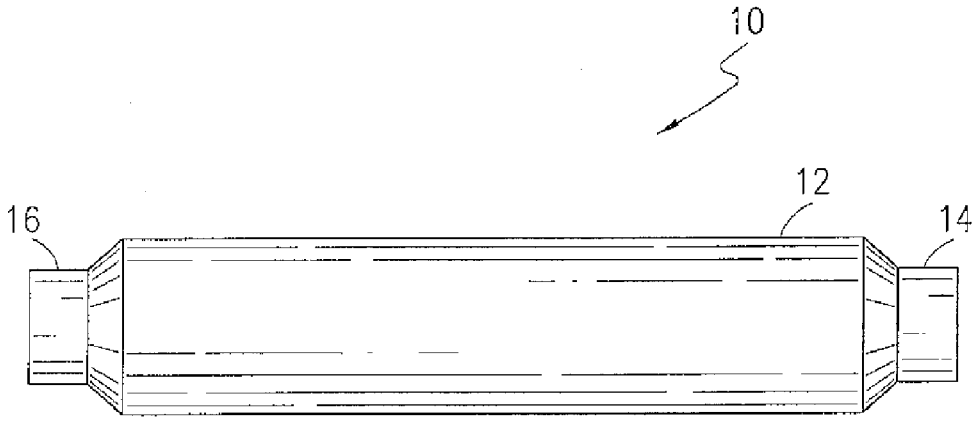
FIG. 2 is a side view thereof.
Figure 3:
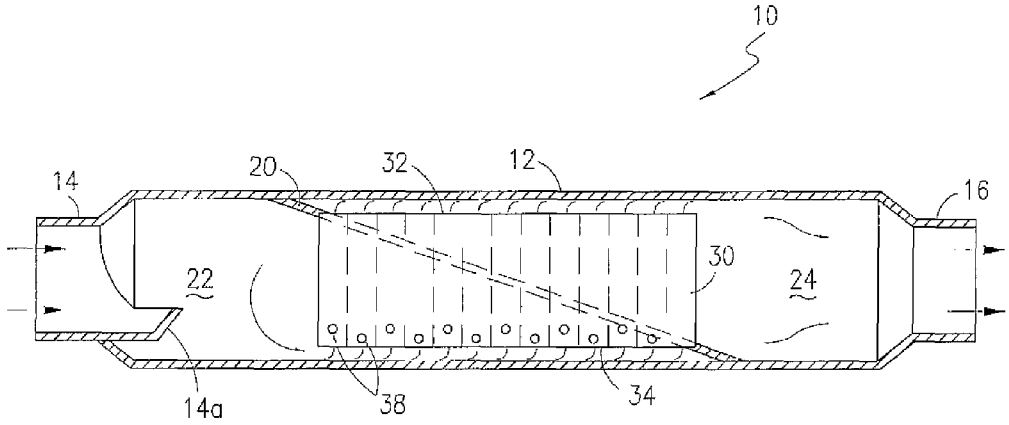
FIG. 3 is a side sectional view thereof.

With reference now to the drawings, FIGS. 1-5 depict a preferred embodiment of a muffler, generally referenced as 10, in accordance with the present invention. Muffler 10 is primarily characterized as having an elongate generally hollow muffler housing 12 formed about a longitudinal axis with opposing ends forming an open inlet 14 and an open outlet 16. In a preferred embodiment, housing 12 comprises a generally cylindrical structure fabricated from composite material such as temperature resistant fiberglass. While the preferred embodiment is disclosed with a housing that is generally cylindrical, the present invention is suitable for use with housings having various shapes. As best depicted in FIG. 3, muffler housing 12 defines an internal volume and includes an angularly disposed baffle 20, having a peripheral edge in sealing engagement with the inner surface of housing 12, which divides the internal volume into a lower inlet chamber 22 and an upper outlet chamber 24. In a preferred embodiment baffle 20 is generally planar, however, any suitable shape, such as concave or convex, is contemplated and considered within the scope of the present invention. Baffle 20 is angularly disposed and preferably oriented to extend angularly downward from an upper inner surface of housing 12 proximal muffler inlet 14 to a lower inner surface of housing 12 proximal muffler outlet 16. Accordingly, exhaust entering the muffler enters the inlet chamber 22, which chamber is defined by the lower surface of baffle 20 and the internal muffler housing wall. Inlet 14 may further be adapted with a generally upwardly angled lip 14A. Upwardly angled lip 14A functions to attenuate exhaust pressure waves while deflecting exhaust upward toward the underside of baffle 20.

Figure 4:
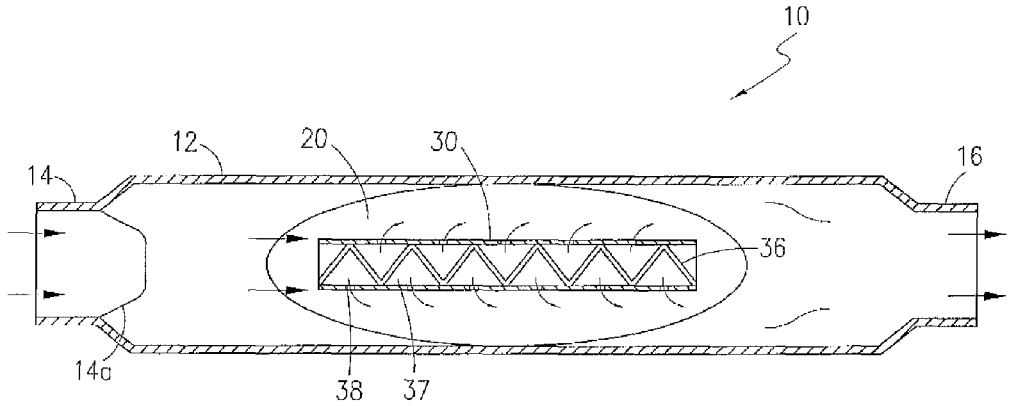
FIG. 4 is a top sectional view thereof.
Figure 5:
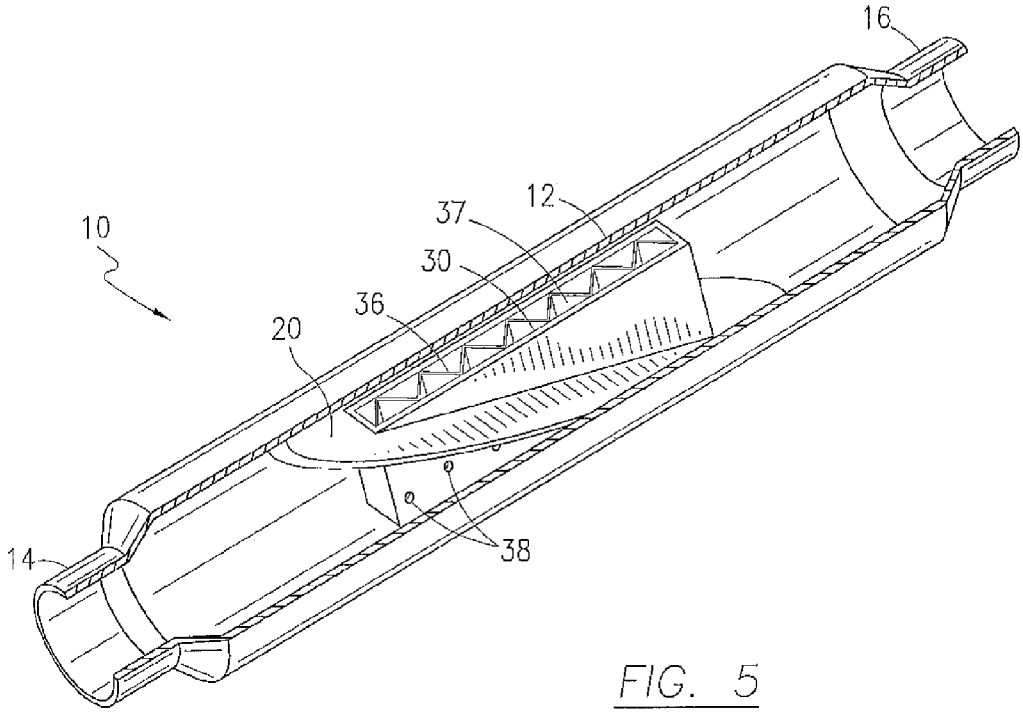
FIG. 5 is perspective sectional view thereof.

Secured to baffle 20 is a generally vertically disposed duct 30 having open top and bottom ends, referenced as 32 and 34 respectively, terminating in spaced relation with the inner surface of housing 12. Duct 30 functions to allow exhaust gas and cooling water entrained therewith to flow from the inlet chamber 22 to the outlet chamber 24. Duct 30 may preferably be further adapted with an internal wall structure 36 forming a plurality of individual flow conduits or passages, referenced as 37. In a preferred embodiment, wall structure 36 is fabricated from a corrugated composite panel, however, any partition structure is considered within the scope of the present invention. Duct 30 is preferably generally vertically disposed and positioned such that a plurality of duct inlets 37A formed at the bottom thereof are positioned in spaced proximity to the lower inner surface of cylindrical housing 12. Similarly, duct outlets, referenced as 37B, are positioned in spaced proximity to the upper inner surface of cylindrical housing 12. The bottom end portion 34 of duct 30 may further be adapted with sidewall apertures 38 for improving exhaust flow dynamics through the duct. Sidewall apertures 38 may be formed for each flow passage, and may be staggered in height from one passage to the other as depicted in FIG. 4. The use of sidewall apertures 38 has been found significant in improving exhaust gas flow dynamics and the entrainment of water through duct inlets at the bottom 34 of duct 30.

As best illustrated in FIG. 3, exhaust gas and exhaust cooling water enter the inlet chamber 22 of muffler 10 via inlet 14 whereby angled lip 14A deflects at least a portion of the exhaust gas and cooling water upward toward the undersurface of inclined baffle 20 thereby increasing the effectiveness of sound attenuation by disrupting the incoming pressure waves. Under certain conditions wherein the engine is operating at relatively low RPM's, it is expected that exhaust gas cooling water will begin to pool on the housing floor within inlet chamber 22. As the water level rises and chokes the flow paths to the duct inlets, the exhaust gas velocity will naturally increase thereby causing entrainment of the water with the exhaust gas. It has been found that sidewall apertures 38 significantly enhance the entrainment of water within the exhaust gas flow stream. The exhaust gas and water exit duct 30 through outlets at the top 32 of duct 30 into outlet chamber 24 whereafter the exhaust gas and entrained cooling water are allowed to exit via muffler outlet 16. A muffler in accordance with the present invention may be fabricated from composite material, such as heat resistant fiberglass, or any other suitable material.

Alternate Embodiments

FIGS. 6-9 depict an alternate embodiment of a marine muffler, generally referenced as 50, in accordance with the present invention. Muffler 50 includes an elongate hollow generally rectangular housing 52. Housing 52 includes exhaust inlet opening 54 and an exhaust outlet opening 56 disposed on opposing sides along the longitudinal axis of the muffler housing 52 to allow for the flow of exhaust and cooling water through the muffler 50. The generally rectangular shape of the muffler housing 52 is advantageous in that it allows for the mounting of the muffler 50 in an easy and effective manner within the generally rectangular shaped cavity that is formed between the stringer supports that run lengthwise in the hull of the vessel. Providing a rectangularly shaped muffler that fits between stringer supports effectively maximizes use of space over mufflers having cylindrical shapes. In addition to easy mounting, the rectangular shaped muffler 100 conserves space for other instruments within the hull of the boat, by fitting precisely into the compact region that is defined by the supports within the hull.

Figures 6, 7:
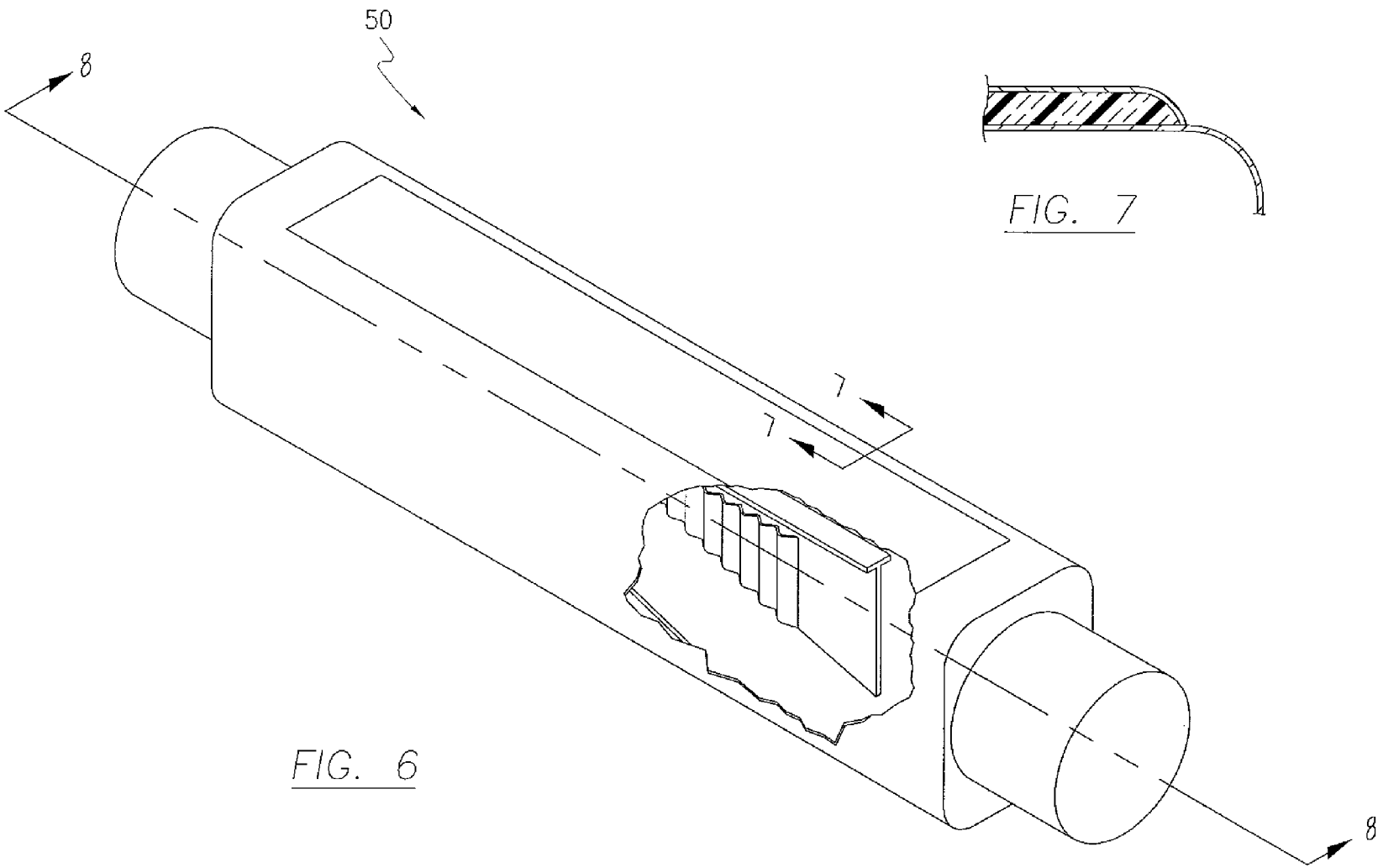
FIG. 6 is a perspective view with partial cut-away of an alternate embodiment of the marine engine muffler having a rectangular housing.
FIG. 7 is a side cross sectional view of a portion of the marine engine muffler housing.

As best illustrated by FIGS. 6 and 7, muffler 50 includes a hollow rectangular shaped housing 52 that defines a contained volume which includes an angularly disposed (e.g. inclined) baffle 58. Baffle 58 is generally rectangular in shape, such that the peripheral edges of the baffle 58 are in contact with the inner walls of the housing in a sealed configuration. The angular disposition of the baffle 58 is created, such that the periphery of one longitudinal end of the baffle 58 is coupled in a sealed configuration to the inner surface of the top wall of the muffler housing 52 at a point in proximity to the inlet opening 54, and the opposing longitudinal end of the periphery of the baffle 58 is coupled in a sealed configuration to the inner surface of the bottom wall of the muffler housing 52 at a point in proximity to the outlet opening 56. Through the angular configuration, the baffle 58 divides the contained volume within the muffler housing 52 into a lower chamber 60 and an upper chamber 62. The lower chamber 60 is defined as the region of the contained inside chamber that is directly adjacent to the inlet opening 54 formed between the bottom of the angularly disposed baffle 58 and the inner surface of the lower wall of the muffler housing 58, through which exhaust and cooling liquid flows into the muffler 50. The upper chamber 62 is defined as the region of the contained inside chamber that is directly adjacent to the outlet opening 56 formed between the top of the baffle 58 and the inner surface of the upper wall of the muffler housing 58, through which exhaust and cooling liquid flow out from the muffler 50, Baffle 58 is preferably fabricated from a solid material that is impervious to water and gas penetration. In a contemplated alternate embodiment, however, baffle 58 is fabricated from material that may be penetrated by water and/or gas. In such an embodiment, baffle 58 provides significant reduction in emissions by essentially absorbing fluid or particulate matter, similar to an air filter.

Figure 8:
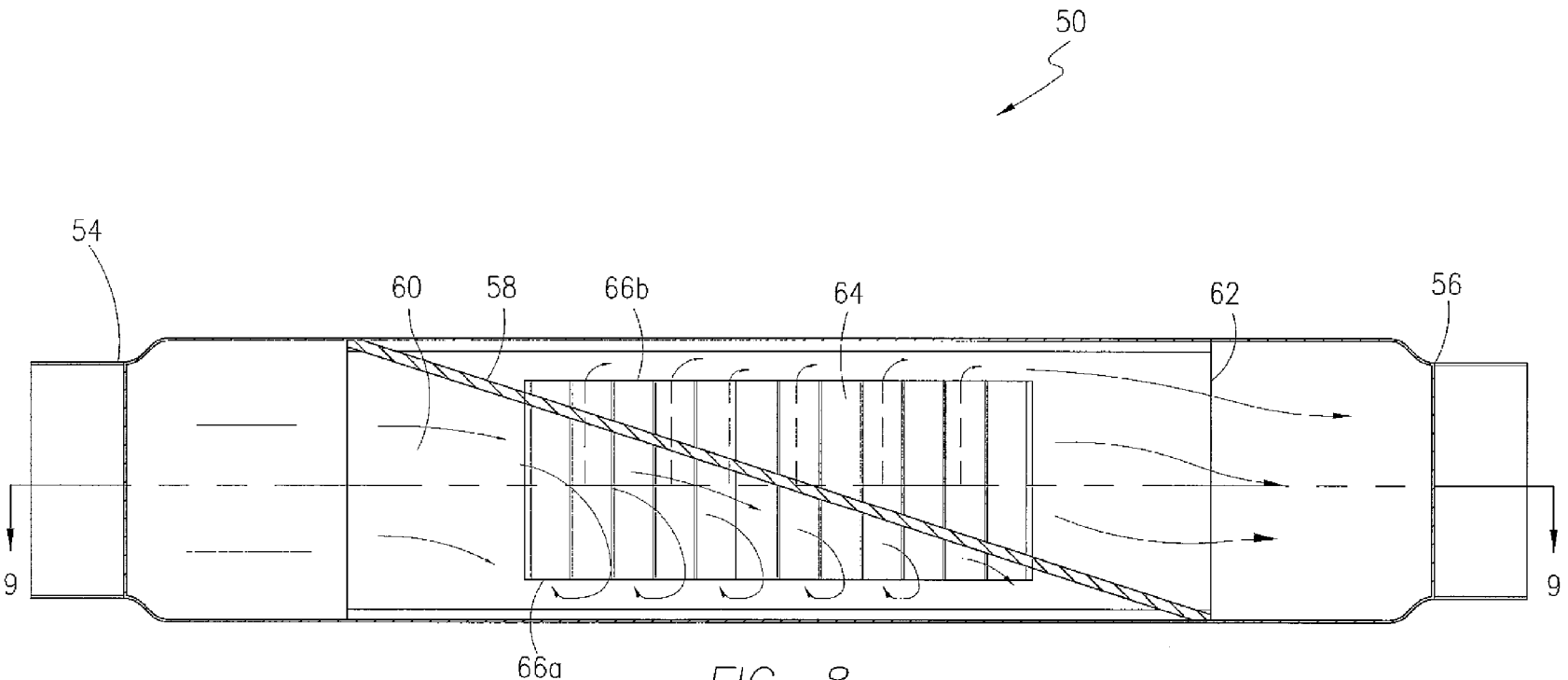
FIG. 8 is a side sectional view of the marine engine muffler depicted in FIG. 6.

As best seen in FIGS. 6 and 8, a plurality of support beams 62, extend longitudinally across substantially the entire longitudinal length of the baffle 58, with the top and bottom portions of the beams being rigidly connected to the upper and lower housing walls. In a preferred embodiment, support beams 62 comprise I-beam type beams so that the flanges that extend out from the top and bottom of the support beams 62 are rigidly secured in a flushed configuration against the inner surface of the upper and lower walls of the muffler housing 52. Beams 62 function to add rigidity to the planar housing walls. This structure is considered significant since, if left un-reinforced, the planar housing walls would otherwise be subject to excessive vibration resulting from the exhaust gas pulsation. It is for that reason, that most marine mufflers known in the art utilize cylindrical housings. The present invention thus overcomes the cylindrical housing limitation by, in one embodiment, using a rectangular housing with reinforced/stiffened walls. Beams 62 are preferably configured in a parallel configuration, such that the baffle 58 bisects each beam 62 along the diagonal formed between upper and lower corners on opposing side of each support beam 62. The beams 62 serve to support the baffle 58 in an angled position and also serve to make the muffler 50, including both the housing 52 and the baffle 58, more rigid. By making the muffler 50 more rigid, vibrations caused by the pressurized waves created by exhaust flow dynamics through the muffler 50 are dampened, thereby reducing the noise of the muffler 50 and the corresponding overall exhaust system.

At least one duct 64, and preferably a series of ducts, are disposed vertically along the sides of the beams 64 that extend between the inner surfaces of the upper and lower walls of the muffler housing 52, while terminating in spaced relation with the upper and lower walls. Each duct 64 extends through the upper and lower surfaces of the baffle 58 thereby providing a flow conduit for exhaust gas and cooling water to travel from the lower chamber to the upper chamber. In a preferred embodiment, each duct 64 is made up of a corrugated panel that is coupled in a vertical configuration directly to the side walls of the beam support 62, however, in a contemplated alternate embodiment the duct may simply comprise one or more hollow tubular members the penetrate through the baffle. Through the use of a corrugated panel in creating the ducts, a series of flow conduits and passageways 66 are created. The corrugated panel that is used to create each duct 64 extends through the top and bottom of surfaces of the angled baffle 58, such that the flow conduits 66 extend between the lower and upper chambers 60 and 62 that are created by the angled baffle 58. In extending through the angled baffle 58, the corrugated panel creates a series of passageway inlet openings 66A in the lower chamber 60 and a series of passageway outlet openings 66B in the top chamber, allowing for the dynamic flow of exhaust and cooling liquid through the muffler 50.

The corrugated panel can also include a series of sidewall apertures that extend through the panel in the lower chamber 60 at positions directly adjacent to each passageway inlet openings 66A. These sidewall apertures can be staggered in height positioning along the corrugated panel. The use of sidewall apertures in the passageway 66 of the present invention, helps to insure that the exhaust and cooling liquid can flow into the passageway, thereby ensuring that a flow of exhaust is created through the muffler 50, even when the inlet openings 66A are submerged under cooling liquid that collects at the bottom of the lower chamber 60. In particular, the cooling liquid pools on the floor of the lower chamber 60 of the muffler 50 when the engine is operated at low RPM's.

Figure 9:
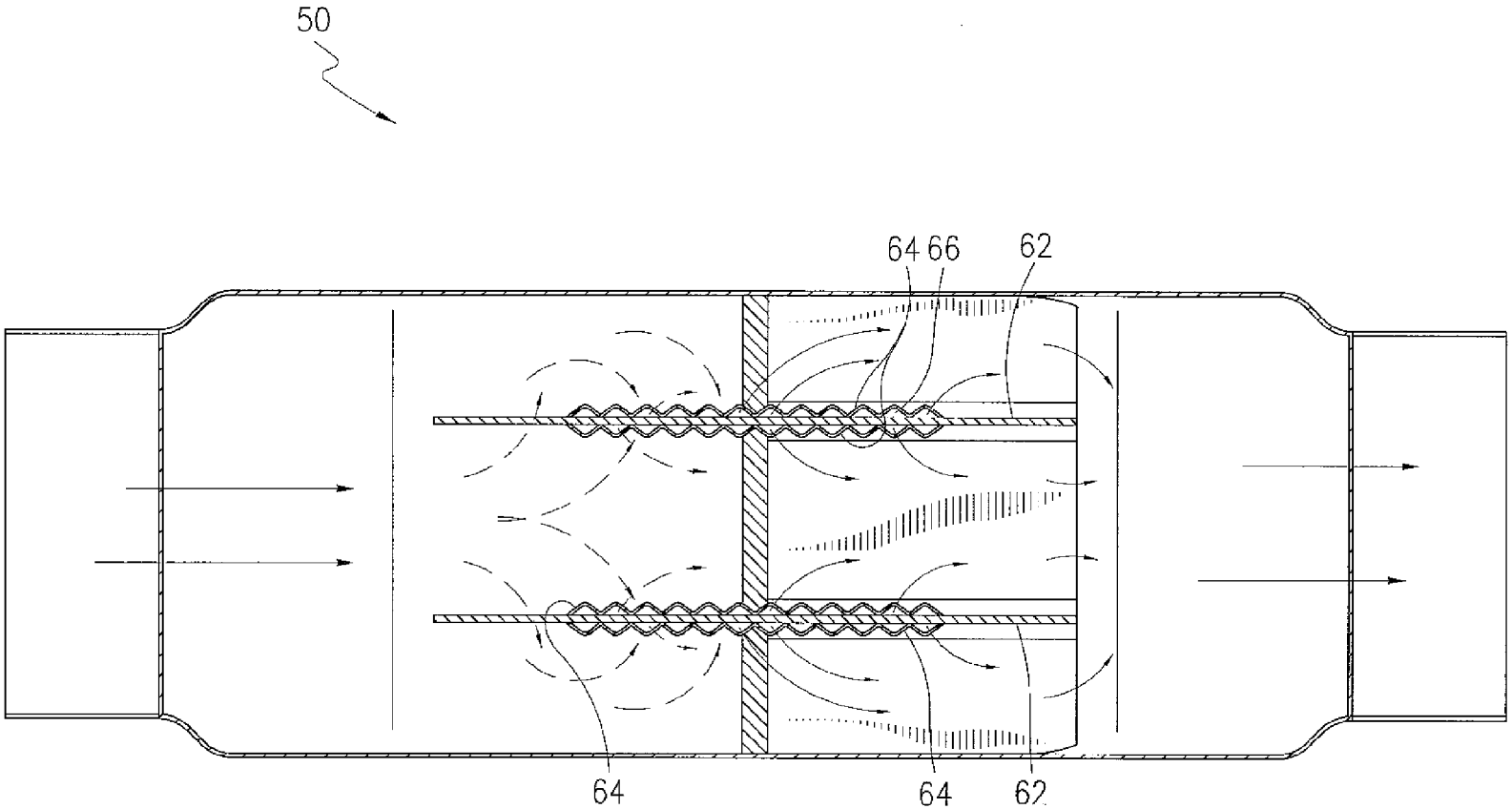
FIG. 9 is a top cross sectional view of an alternate embodiment marine engine muffler.

As with previous embodiments, in the operation of the muffler and as best illustrated by FIGS. 8 and 9, the exhaust and cooling liquid flows into the muffler through the inlet opening 54. The device can include an angled lip at the inlet opening 54 to deflect the pressure waves created by the exhaust flow dynamics, thereby further increasing the effectiveness of the sound attenuation ability of the muffler 50. An example of such a lip structure is shown in the primary embodiment, referenced as 14A depicted in FIG. 3. After entering into the lower chamber 60 of the muffler 50, the exhaust flow dynamic collides with the angled baffle 58 and is subsequently pushed down toward the bottom of the lower chamber. The exhaust and coolant flow then proceeds into the passageways 66 that are created by the corrugated panel through either the sidewall apertures or the passageway inlet openings 66*a*. The exhaust and coolant flow is directed into the upper chamber 62 through the passageway outlet opening 66*b* and out of the upper chamber through the outlet duct opening 56. By redirecting the exhaust flow dynamics through a series of passageways 66 within a duct 64, the pressure waves that are created by the flow of the exhaust and cooling liquid are disrupted, thereby effectively attenuating the sound waves that are associated with the pressure waves.

Figure 10:
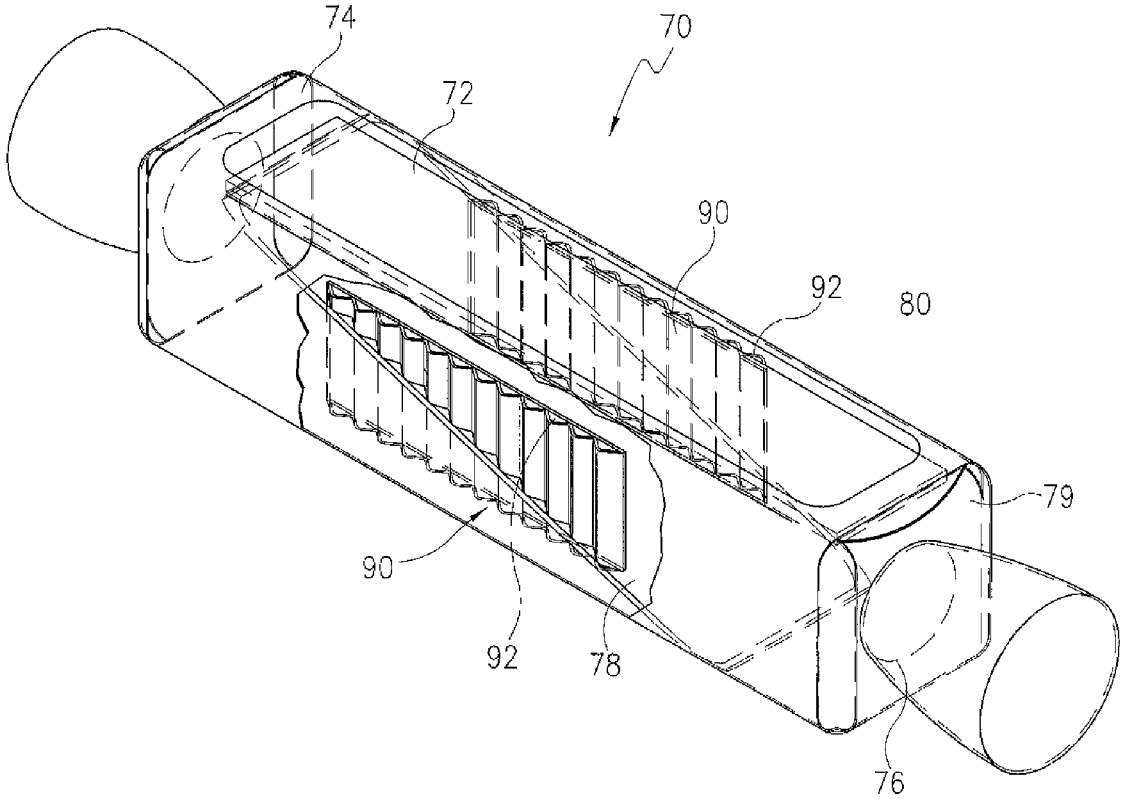
FIG. 10 is a perspective view with partial side cut-away of an alternate embodiment having corrugated panels coupled directly to each opposing inner sidewall of the muffler housing.
Figure 11:
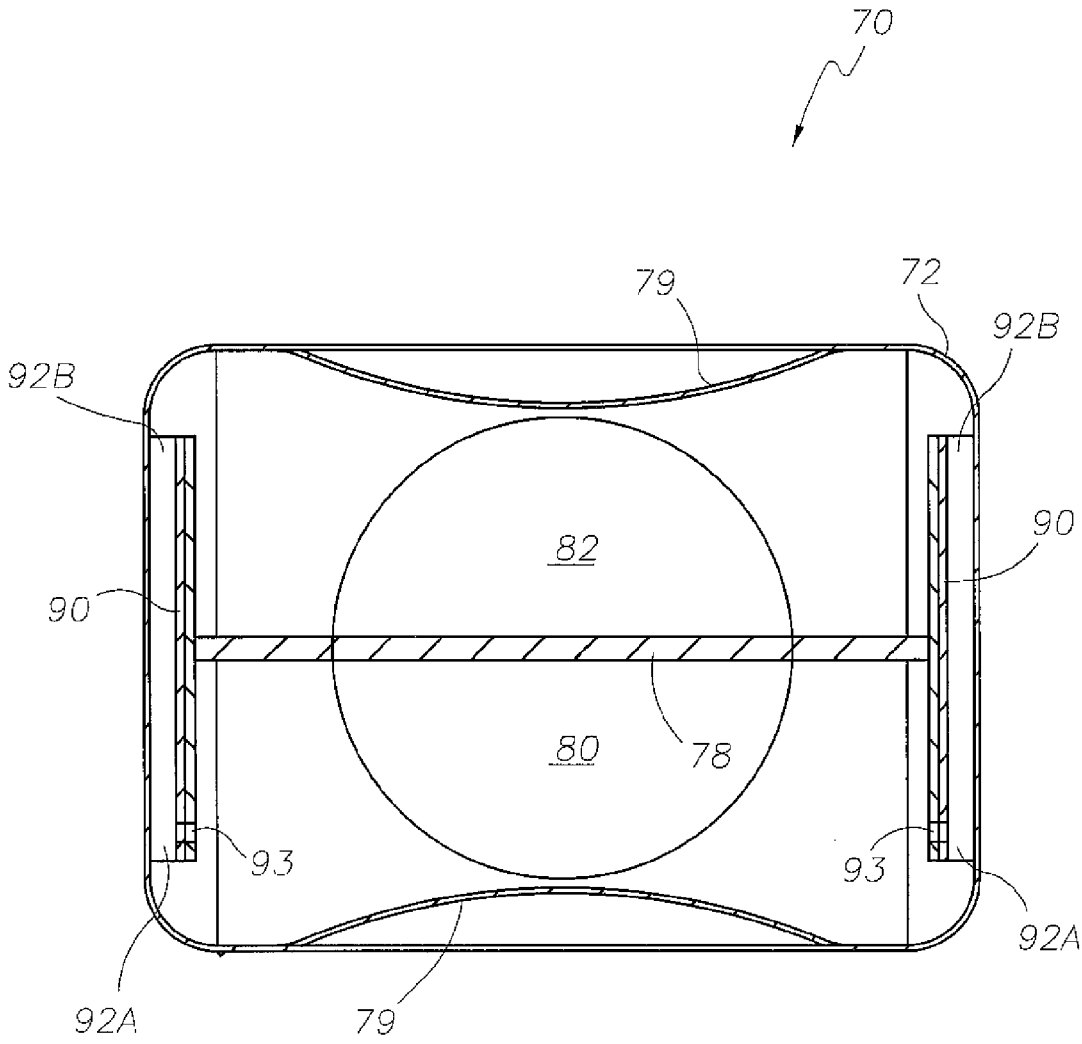
FIG. 11 is a sectional view thereof.

FIGS. 10 and 11 disclose an alternate embodiment muffler, generally referenced as 70, wherein a series of ducts, created by a corrugated panel that is coupled directly to each opposing inner sidewall of the muffler housing, are formed. Muffler 70 includes an elongate hollow generally rectangular housing 72. Housing 72 includes exhaust inlet opening 74 and an exhaust outlet opening 76 disposed on opposing sides along the longitudinal axis of the muffler housing 72 to allow for the flow of exhaust and cooling water through the muffler 70. The generally rectangular shape of the muffler housing 72 is advantageous in that it allows for the mounting of the muffler 70 in an easy and effective manner within the generally rectangular shaped cavity that is formed between the stringer supports that run lengthwise in the hull of the vessel. Providing a rectangularly shaped muffler that fits between stringer supports effectively maximizes use of space over mufflers having cylindrical shapes. In addition to easy mounting, the rectangular shaped muffler 70 conserves space for other apparatus within the hull of the boat, by fitting precisely into the compact region that is defined by the supports within the hull.

Muffler 70 includes a hollow rectangular shaped housing 72 that defines a contained volume which includes an angularly disposed baffle 78. Baffle 78 is generally rectangular in shape, such that the peripheral edges of the baffle 78 are in contact with the inner walls of the housing in a sealed configuration. The inclined disposition of the baffle 78 is created, such that the periphery of one longitudinal end of the baffle 78 is coupled in a sealed configuration to the inner surface of the top wall of the muffler housing 72 at a point in proximity to the inlet opening 74, and the opposing longitudinal end of the periphery of the baffle 78 is coupled in a sealed configuration to the inner surface of the bottom wall of the muffler housing 72 at a point in proximity to the outlet opening 76. Through the angular configuration, the baffle 78 divides the contained volume within the muffler housing 72 into a lower chamber 80 and an upper chamber 82. The lower chamber 80 is defined as the region of the contained inside chamber that is directly adjacent to the inlet opening 74 formed between the bottom of the angularly disposed baffle 78 and the inner surface of the lower wall of the muffler housing 72, through which exhaust and cooling liquid flows into the muffler 70. The upper chamber 82 is defined as the region of the contained inside chamber that is directly adjacent to the outlet opening 76 formed between the top of the baffle 78 and the inner surface of the upper wall of the muffler housing 72, through which exhaust and cooling liquid flow out from the muffler 70. Baffle 78 is preferably fabricated from a solid material that is impervious to water and gas penetration. In a contemplated alternate embodiment, however, baffle 78 is fabricated from material that may be penetrated by water and/or gas. In such an embodiment, baffle 78 provides significant reduction in emissions by essentially absorbing fluid or particulate matter, similar to an air filter.

In the embodiment depicted in FIG. 10, corrugated panel 90 is attached to the inner surface of side walls of housing 72 so as to from a plurality of generally vertically disposed ducts, referenced as 92 in close proximity to the inner side walls of housing 72. Ducts 92 extend between the inner surfaces of the upper and lower walls of the muffler housing 72, while terminating in spaced relation with the upper and lower walls. Each duct 90 extends through the upper and lower surfaces of the baffle 78 thereby providing a flow conduit for exhaust gas and cooling water to travel from the lower chamber to the upper chamber. Corrugated panel 90 that is used to create duct 92 extends through the top and bottom of surfaces of the angled baffle 78, such that the ducts 92 form flow conduits extending between the lower and upper chambers 80 and 82. In extending through the angled baffle 58, the corrugated panel creates a series of duct inlet openings 92A in the lower chamber 80 and a series of duct outlet openings 92B in the top chamber, allowing for the dynamic flow of exhaust and cooling liquid through the muffler 70. The present inventor has found that by forming ducts 92 in a non-circular cross-sectional shape improves exhaust silencing by disrupting pressure wave propagation through muffler 70.

The corrugated panel can also include a series of sidewall through bore apertures 93 that extend through the panel in the lower chamber 80 at positions directly adjacent or in proximity to each duct inlet openings 92A. Sidewall apertures 93 can be staggered in height positioning along the corrugated panel. The use of sidewall apertures in the proximity to duct openings 92A helps to ensure that the exhaust and cooling liquid can flow into the passageway, thereby ensuring that a flow of exhaust is created through the muffler 70, even when the inlet openings 92A are submerged under cooling liquid that collects at the bottom of the lower chamber 80. In particular, the cooling liquid pools on the floor of the lower chamber 80 of the muffler 70 when the engine is operated at low RPM's.

A further significant advancement present in the embodiment depicted in FIGS. 10 and 11, relates to the affixation of arcuate panels, namely a top arcutate insert panel 79 and a bottom arcuate insert panel 80, that are affixed within housing 72 in generally parallel relation with the inner top and bottom surfaces so as to form generally convex inner top and bottom surfaces. Arctuate panels 79 and 80 function to provide convex surfaces within the housing for reflecting pressure waves, while further functioning to stiffen the top and bottom housing walls so as to prevent excessive vibration that would result in increased noise propagation. Accordingly, the use of arcuate panels 79 and 80 provide an alternate upper and lower housing stiffening structure as compared to I-beam structures found in the embodiment depicted in FIGS. 6-9, while affixation of the corrugated panels to opposing sides of the housing provides stiffening structure to the housing side walls.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A muffler for a marine engine, said muffler comprising:

a generally hollow housing having a first end including an inlet and a second end including an outlet;

an inclined baffle contained within said housing and disposed between said housing inlet and outlet, said inclined baffle dividing said housing into an inlet chamber disposed below said baffle, and an outlet chamber disposed above said baffle;

a duct, having a non-circular cross-section, projecting through said baffle and generally vertically disposed within said housing, said duct having at least one lower inlet in communication with said inlet chamber and at least one upper outlet in communication with said outlet chamber.

2. A muffler for a marine engine according to claim 1, wherein said duct defines a plurality of side wall apertures in proximity to said at least one lower inlet.

3. A muffler for a marine engine according to claim 1, wherein said duct defines a plurality of flow passages.

4. A muffler for a marine engine according to claim 1, wherein said baffle is generally planar.

5. A muffler for a marine engine according to claim 1, wherein said baffle is generally concave.

6. A muffler for a marine engine according to claim 1, wherein said baffle is generally convex.

7. A muffler for a marine engine, said muffler comprising:

a generally hollow housing having a longitudinal axis, said housing having an inner surface and opposing ends defining an inlet and an outlet;

a baffle contained within said housing, said baffle having a peripheral edge in sealing engagement with said housing inner surface, said baffle inclined between said inlet and said outlet such that said housing is partitioned into an inlet chamber defined below said baffle, and an outlet chamber defined above said baffle;

a duct projecting through said baffle and generally vertically disposed within said housing, said duct having a lower portion defining at least one inlet in communication with said inlet chamber and an upper portion defining at least one outlet in communication with said outlet chamber, said at least one duct inlet being in spaced proximity with a lower portion of said housing, said at least one duct outlet being in spaced proximity with an upper portion of said housing;

said duct including defining a plurality of passageways having non-circular cross-sections.

8. A muffler for a marine engine according to claim 7, wherein said duct lower portion defines a plurality of side wall apertures.

9. A muffler for a marine engine according to claim 8, wherein said duct includes an internal wall structure partitioning said duct into a plurality of flow passages.

10. A muffler for a marine engine according to claim 8, wherein said baffle is generally planar.

11. A muffler for a marine engine according to claim 8, wherein said baffle is concave.

12. A muffler for a marine engine according to claim 8, wherein said baffle is convex.

13. A muffler for a marine engine, said muffler comprising:

a generally hollow rectangular housing having a longitudinal axis, said housing having an inner surface, and including an inlet, an outlet, a top portion and a bottom portion;

a baffle contained within said housing, said baffle having a peripheral edge in sealing engagement with said housing inner surface, said baffle inclined between said inlet and said outlet such that said housing is partitioned into an inlet chamber defined below said baffle, and an outlet chamber defined above said baffle;

a duct projecting through said baffle and generally vertically disposed within said housing, said duct having a lower portion defining at least one inlet in communication with said inlet chamber and an upper portion defining at least one outlet in communication with said outlet chamber, said at least one duct inlet being in spaced proximity with a said housing bottom, said at least one duct outlet being in spaced proximity with said housing top;

a first arcuate insert disposed within said housing top portion forming a generally convex inner top surface; and a second arcuate insert disposed within said housing bottom portion forming a generally convex inner bottom surface.

* * * * *